US010349796B2

(12) United States Patent
De Wit et al.

(10) Patent No.: US 10,349,796 B2
(45) Date of Patent: Jul. 16, 2019

(54) DEVICE FOR CLEANING A SURFACE, COMPRISING AT LEAST ONE ROTATABLE BRUSH

(75) Inventors: Bastiaan Johannes De Wit, Eindhoven (NL); Fokke Roelof Voorhorst, Eindhoven (NL); Johannes Tseard Van Der Kooi, Eindhoven (NL); Sepas Setayesh, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 1132 days.

(21) Appl. No.: 13/640,364

(22) PCT Filed: May 16, 2011

(86) PCT No.: PCT/IB2011/052135

§ 371 (c)(1),
(2), (4) Date: Oct. 10, 2012

(87) PCT Pub. No.: WO2011/145039

PCT Pub. Date: Nov. 24, 2011

(65) Prior Publication Data

US 2013/0025077 A1 Jan. 31, 2013

(30) Foreign Application Priority Data

May 20, 2010 (EP) ..... 10163373

(51) Int. Cl.
*A46B 13/02* (2006.01)
*A47L 11/292* (2006.01)
(Continued)

(52) U.S. Cl.
CPC ..... *A47L 11/292* (2013.01); *A46D 1/00* (2013.01); *A47L 9/0477* (2013.01); *A46B 13/001* (2013.01)

(58) Field of Classification Search
CPC ..... A46B 13/001; A46B 3/00; A46B 3/22; A46D 1/00; A47L 11/292; A47L 11/4016;
(Continued)

(56) References Cited

U.S. PATENT DOCUMENTS 1,464,031 A * 8/1923 Daly ..... A47L 11/292 15/50.3
1,543,972 A * 6/1925 Adams ..... A47L 9/0422 15/356
(Continued)

FOREIGN PATENT DOCUMENTS

DE 19536775 * 4/1997 ..... A61B 13/001
DE 19536775 A1 4/1997
(Continued)

OTHER PUBLICATIONS

Niebling: "Kunstborsten", Oct. 21, 2004, XP00602552, http://www.niebling.de/download.php?id=259.
(Continued)

*Primary Examiner* — Joseph J Hail
*Assistant Examiner* — Arman Milanian

(57) ABSTRACT

A device for cleaning a surface (11) comprises at least one rotatable brush (3,4) which is provided with flexible brush elements (18) for contacting the surface (11) and picking up dirt particles (10) and liquid which are present on the surface (11) during a dirt pick-up period of each revolution of the brush (3, 4), and means for driving the brush (3, 4). A linear mass density of the flexible brush elements (18) is chosen such as to be lower than 50 g per 10 km, at least at tip portions, and an acceleration at tips of the brush elements (18) is set such as to be at least 3,000 m/sec$^2$, at least at some time during another period of each revolution of the brush
(Continued)

(3, 4) than the dirt pick-up period, namely a period in which the brush elements (18) are free from contact to the surface (11).

13 Claims, 3 Drawing Sheets

(51) Int. Cl.
*A46D 1/00* (2006.01)
*A47L 9/04* (2006.01)
*A46B 13/00* (2006.01)

(58) Field of Classification Search
CPC ..... A47L 11/4036; A47L 11/0477; A47L 11/185; A47L 11/29; A47L 11/302; B08B 1/04
USPC ..... 15/50.3, 21.1, 179
See application file for complete search history.

(56) References Cited

U.S. PATENT DOCUMENTS 1,694,937 A * 12/1928 Floeter ..... 15/50.3
1,759,881 A * 5/1930 Bentley ..... A47L 11/302 15/384
2,879,534 A * 3/1959 Swanson et al. ..... 15/179
4,624,025 A * 11/1986 Kaulig et al. ..... 15/41.1
4,654,916 A * 4/1987 Postonen ..... A47L 11/292 15/1.7
4,706,320 A * 11/1987 Swift ..... 15/1.51
4,845,794 A * 7/1989 Korski et al. ..... 15/51
5,086,539 A * 2/1992 Rench ..... A47L 5/30 15/320
5,806,126 A * 9/1998 de Larios ..... A46B 11/06 134/26
5,903,951 A * 5/1999 Ionta et al. ..... 15/180
6,352,471 B1 * 3/2002 Bange et al. ..... 451/527
6,588,050 B1 * 7/2003 Aiken ..... 15/320
6,662,402 B2 * 12/2003 Giddings ..... A47L 11/292 15/320
7,143,461 B2 * 12/2006 Spooner ..... 15/41.1
7,475,450 B1 * 1/2009 Ragner ..... 15/384
7,967,914 B2 * 6/2011 Giddings et al. ..... 134/6
8,028,365 B2 * 10/2011 Field ..... A47L 11/18 15/230.14
8,083,860 B2 * 12/2011 Loftis ..... A46B 13/005 134/21
8,495,781 B2 * 7/2013 Dingert ..... A47L 11/22 15/320
8,555,446 B2 10/2013 Moes
2002/0148061 A1 10/2002 Tanaka et al.
2003/0159232 A1 * 8/2003 Hekman et al. ..... 15/320
2006/0236494 A1 * 10/2006 Nelson et al. ..... 15/320
2006/0282975 A1 * 12/2006 Basham et al. ..... 15/320
2007/0189793 A1 * 8/2007 Thayer et al. ..... 399/55
2007/0221248 A1 * 9/2007 Boatman ..... 134/6
2009/0293912 A1 * 12/2009 Giddings ..... A47L 11/185 134/6
2011/0180105 A1 * 7/2011 Moes ..... A47L 11/085 134/6
2011/0191968 A1 * 8/2011 Moes ..... A46B 11/002 15/21.1
2013/0025077 A1 1/2013 De Wit

FOREIGN PATENT DOCUMENTS

EP 0169850 B1 4/1990
GB 338414 * 11/1930 ..... A47L 9/0477
GB 2090124 * 7/1982 ..... A47L 9/0444
JP 2001145595 A 5/2001
JP 2003052584 A * 2/2003 ..... A47L 9/04
JP 2003189939 A 7/2003
WO 8701266 A1 3/1987
WO WO8701266 * 3/1987 ..... A46B 5/00
WO 2010041185 A1 4/2010
WO WO2010041185 * 4/2010 ..... A47L 11/282

OTHER PUBLICATIONS

Niebling: "Screenshot with date of file "Kunstborsten"", http://www.niebling.de/showpage.php?SiteID=15295.

* cited by examiner

DEVICE FOR CLEANING A SURFACE, COMPRISING AT LEAST ONE ROTATABLE BRUSH

FIELD OF THE INVENTION

The present invention relates to a device for cleaning a surface, comprising at least one rotatable brush which is provided with flexible brush elements for contacting the surface to be cleaned and picking up dirt particles and liquid which are present on the surface during a dirt pick-up period of each revolution of the brush, and means for driving the brush.

BACKGROUND OF THE INVENTION

U.S. Pat. No. 1,694,937 discloses a floor scrubbing machine, which is capable of picking up dirt and water from a floor by two cylindrical floor brushes disposed parallel and close together and rotated at high speed, one running clockwise and the other counter clockwise, the adjacent peripheries traveling together and with velocity sufficient to project the dirt and water vertically upward with considerable force in the form of a substantially flat jet. A deflecting or baffling means is provided above the brushes, whereby the upward jet, after having risen clear of the brushes, is checked and diverted to a dirt receptacle.

The action in respect of the upward delivery of dirt and water in the scrubbing machine appears to be as follows. Individual masses of dirt and liquid, discharged by centrifugal force from the periphery of a brush, either strike the periphery of the opposite brush and are impelled upward again, or they collide with similar masses thrown off from the other brush, resulting in the dirt and water shooting vertically upward clear of the brushes in the form a substantially flat jet. Practically all of the dirt and water is thrown off from the brushes during the first half revolution. The brushes arranged and operating in the manner as described lift the water without additional suction means or any elevating devices.

It is stated that the high speed brushes remove practically all the water from the floor. However, it is possible that a small amount remains. In order to collect such small amount, the scrubbing machine is equipped with a wiper or a squeegee.

EP 0 169 850 discloses an apparatus that has many aspects in common with the scrubbing machine known from U.S. Pat. No. 1,694,937. In particular, EP 0 169 850 discloses an apparatus for cleaning of preferably hard surfaces like floors, stairs and the like. The apparatus has two against each other rotating, substantially cylindrical brushes, through which the apparatus is supported on the surface, and means for supply of liquid detergent to the brushes, wherein the brushes are arranged to transport dirt particles by means of their rotation between them to at least one container.

The apparatus rests with its brushes against the surface to be cleaned in such a way that their bristles are deformed at the contact with the surface when the brushes rotate. The bristles are moistened, and when the bristles come into contact with the surface, liquid detergent is brought to the surface and binds the dirt particles which to some extent also stick to the bristles. At the contact with the surface, the bristles are bent backwards. As a result, an area contact is achieved instead of a line contact. The bending of the bristles comes to an end when the bristles, during continued rotation, lose contact with the surface, whereby dirt particles are thrown in a tangential direction because of a fast straightening of the bristles. Scraping edges are applied in order to ensure that dirt particles that may remain on the bristles will be scraped away and fall down to the surface in order to be thrown up by the bristles a next time.

It appears from the foregoing that the use of two counter-rotating brushes for cleaning a floor is known in the art. Furthermore, it appears that additional means are used as well in order to achieve acceptable cleaning results. In the scrubbing machine known from U.S. Pat. No. 1,694,937, a wiper or a squeegee is applied in addition to the brushes in order to have a dry floor. In the apparatus known from EP 0 169 850, scraping edges are applied in order to ensure proper continuous cleaning of the brushes in the apparatus, wherein dirt particles fall down to the surface to be cleaned. These dirt particles need to be picked up again, wherein there is a risk that they stick to the brushes once again, and are made to fall down to the surface to be cleaned once again. Other disadvantages reside in the fact that the use of scraping edges increases the power needed for rotating the brushes, wherein a rate at which the brushes suffer from wear and tear is increased as well, and in the fact that during contact of the brushes to a surface to be cleaned, forces such as elastic forces are exerted on the surface, which are generated by the individual bristles, as a result of which friction forces and heat are generated, which may lead to damage of the surface.

It is an object of the present invention to realize a use of at least one rotatable brush for cleaning a surface with an optimal combination of operating parameters, i.e. a combination of operating parameters which ensures an optimal cleaning function of the brush, wherein there is no need for additional means for performing a cleaning action on a surface besides the brush, or for additional means for keeping the brush clean during operation. In other words, it is an object of the present invention to find an optimal combination of operating parameters for the brush, wherein it is possible to clean and dry a surface by only using the functionality of the brush.

SUMMARY OF THE INVENTION

The object of the present invention is achieved by a device for cleaning a surface, comprising at least one rotatable brush which is provided with flexible brush elements for contacting the surface to be cleaned and picking up dirt particles and liquid which are present on the surface during a dirt pick-up period of each revolution of the brush, and means for driving the brush, wherein a linear mass density of a majority of a total number of the brush elements of the brush is lower than 150 g per 10 km, at least at tip portions of the brush elements which are used for picking up dirt particles and liquid, and wherein the means for driving the brush are adapted to realize an acceleration at tips of the brush elements in the device which is at least 3,000 m/sec$^2$, at least at some time during another period of each revolution of the brush than the dirt pick-up period, namely a period in which the brush elements are free from contact to the surface, and first move away from the surface and subsequently move towards the surface again.

It appears that with the combination of parameters as mentioned, i.e. the linear mass density of the flexible brush elements with an upper limit of 150 g per 10 km, at least at tip portions of the brush elements which are used for picking up dirt particles and liquid, and the acceleration at the tips of the brush elements with a lower limit of 3,000 m/sec$^2$ in a contact-free period, it is possible to realize excellent cleaning results, wherein a surface to be cleaned is practically freed of dirt particles and dried in one go. Hence, when the device according to the present invention is used, conventional issues like the need for an additional use of wiping means and/or suction/vacuum means for cleaning the surface, and/or scraping means for keeping the brush clean are no longer applicable. Furthermore, the brush is kept clean at all times, so that there is no risk of distributing dirt over a surface to be cleaned.

The combination of parameters is not found on the basis of knowledge of the prior art, as the prior art is not even concerned with a possibility of having an autonomous, optimal functioning of at least one rotatable brush which is used for cleaning a surface, as appears from the foregoing description of two examples of prior art documents relating to an application of two rotatable brushes for the cleaning purpose as mentioned.

When at least one rotatable brush is provided and operated as described by the present invention, it is ensured that liquid can be effectively removed from a surface to be cleaned, and that the same goes for dirt particles, which may be caught by the brush elements of the brush and/or be taken along with the liquid. The cleaning process which is performed by means of the brush is especially suitable to be applied to hard surfaces, and has various aspects, all of which contribute to the effectiveness of the cleaning process, alone and/or in combination with other aspects. Examples of hard surfaces are hard floors, windows, walls, tabletops, plates of hard material, sidewalks, etc.

During rotation of the brush, acceleration forces such as centrifugal forces are exerted on the brush and the brush elements. Besides the centrifugal forces as mentioned, other acceleration forces can be present, particularly acceleration forces which are due to deformation of the flexible brush elements. Among other things, such deformation can occur as soon as a flexible brush element encounters liquid or a dirt particle. Also, it is possible that the device according to the present invention comprises means for setting an indentation of the brush, for example, by positioning a central axis of the brush at a smaller distance with respect to the surface to be cleaned than a radius of the brush relating to a fully outstretched condition of the brush elements, as a result of which the brush elements are bent when the brush is in contact with the surface. Hence, in that case, as soon as the brush elements come into contact with the surface during rotation of the brush, the appearance of the brush elements changes from an outstretched appearance to a bent appearance, and as soon as the brush elements lose contact with the surface during rotation of the brush, the appearance of the brush elements changes from a bent appearance to an outstretched appearance. A practical range for an indentation of the brush is a range from 2% to 12% of a diameter of the brush relating to a fully outstretched condition of the brush elements. In practical situations, the diameter of the brush as mentioned can be determined by performing an appropriate measurement, for example, by using a high speed camera, or a stroboscope which is operated at the frequency of a rotation of the brush.

A deformation of the brush elements, or, to say it more accurately, a speed at which deformation can take place, is also influenced by the linear mass density of the brush elements. Furthermore, the linear mass density of the brush elements influences the power which is needed for rotating the brush. When the linear mass density of the brush elements is relatively low, the flexibility is relatively high, and the power needed for causing the brush elements to bend when they come into contact with the surface to the cleaned is relatively low. This also means that a friction power which is generated between the brush elements and the surface is low, whereby heating up of the surface and associated damage of the surface are prevented. Other advantageous effects of a relatively low linear mass density of the brush elements are relatively high resistance to wear, relatively small chance of damage by sharp objects or the like, and capability to follow a surface in such a way that contact is maintained even when a substantial unevenness in the surface is encountered.

When brush elements come into contact with a dirt particle or liquid, or, in case an indentation of the brush with respect to a surface to be cleaned is set, with the surface as mentioned, the brush elements are bent. As soon as the brush elements with the dirt particles and liquid adhering thereto lose contact with the surface, the brush elements are straightened out, wherein especially the tips of the brush elements are moved with a relatively high acceleration, on top of the normal centrifugal acceleration which is the result of the rotation of the brush. As a result, the liquid droplets and dirt particles adhering to the brush elements are launched from the brush elements, as it were, as the acceleration forces are higher than the adhesive forces. The values of the acceleration forces are determined by various factors, including the deformation and the linear mass density as mentioned, but also the speed at which the brush is driven.

According to the present invention, as defined in the foregoing, the means for driving the brush are adapted to realize an acceleration at tips of the brush elements in the device which is at least 3,000 m/sec$^2$, at least at some time during another period of each revolution of the brush than the dirt pick-up period, namely a period in which the brush elements are free from contact to the surface, and first move away from the surface and subsequently move towards the surface again. A preferred minimum value of the acceleration as mentioned is 7,000 m/sec$^2$, and a more preferred minimum value of the acceleration as mentioned is 12,000 m/sec$^2$. Experiments have shown that cleaning performances of the device according to the present invention improve with an increase of the angular velocity of the brush, which implies an increase of the acceleration.

The liquid used in the process of enhancing adherence of dirt particles to the brush elements may be provided in various ways. In the first place, the rotatable brush and the flexible brush elements may be wetted by a liquid which is present on the surface to be cleaned. An example of such a liquid is water, or a mixture of water and soap. Alternatively, a liquid may be provided to the flexible brush elements by supplying the liquid to the brush in the device, for example, by oozing the liquid onto the brush, or by injecting the liquid into a hollow core element of the brush. Instead of using an intentionally chosen liquid, it is also possible to use a spilled liquid, i.e. a liquid to be removed from the surface to be cleaned. Examples are spilled coffee, milk, tea, or the like. This is possible in view of the fact that the brush elements are capable of totally removing the liquid from the surface to be cleaned, and that the liquid can be removed from the brush elements under the influence of centrifugal forces as described in the foregoing, wherein the liquid can be received in a suitable collecting space in the device of which the brush is part. When the acceleration at the tips of the brush elements is realized such as to be at least 3,000 m/sec$^2$, at least at some time during a period of each revolution of the brush in which the brush elements are free from contact to the surface to be cleaned, and first move away from the surface and subsequently move towards the surface again, in particular at those moments in which the brush elements move back to an outstretched condition after having been bent, it is likely for the droplets of the liquid adhering to the brush elements to be expelled as a mist of droplets from the brush elements, which is advantageous in view of the fact that it is very well possible to collect such droplets, as described in EP 10150263.1 in the name of Applicant, entitled "Hard floor wet cleaning appliance".

The combination of the linear mass density of the brush elements and the acceleration at the tips of the brush elements, i.e. the combination in which the linear mass density is lower than 150 g per 10 km, at least at tip portions of the brush elements which are used for picking up dirt particles and liquid, and the acceleration is at least 3,000 $m/sec^2$ in a contact-free period, is a combination which yields optimal cleaning performance of the rotatable brush, wherein practically all dirt particles and spilled liquid encountered by the brush when operated with the parameters as mentioned are picked up by the brush elements and expelled at a position inside the device of which the brush is part. Naturally, effective picking up of particles and liquid is advantageous when it comes to cleaning, wherein both a dirt removal and drying process are realized. An effective subsequent expelling process is advantageous in view of the fact that a reintroduction of dirt to the surface to be cleaned is avoided. With the brush according to the present invention, and the means for realizing the operating parameters as mentioned, it is even possible to catch particles which are in the so-called HEPA range, i.e. particles which are relatively small, having a diameter which may be less than 1 micrometer.

The cleaning results which are obtained when the present invention is applied are excellent. The achievement of the present invention resides in the fact that a set of factors is chosen such as to realize that during a cleaning action, the brush elements can always be made to contact the surface to be cleaned, even if the surface is uneven at some positions, wherein a contacting area of the brush elements is large enough to actually pick up dirt particles and liquid, and wherein a period of contact between the brush elements and the surface is long enough to realize complete removal of dirt particles and liquid, while a reintroduction of dirt or only a displacement of dirt over the surface is avoided, as the brush is capable of performing an effective self-cleaning action during which dirt particles and liquid are expelled from the brush elements under the influence of acceleration forces which are stronger than adhesive forces.

A factor which may play an additional role in the cleaning function of the rotatable brush is a packing density of the brush elements. When the packing density is large enough, capillary effects may occur between the brush elements, which enhance fast removal of liquid from the surface to be cleaned. For example, the packing density of the brush elements can be at least 30 tufts of brush elements per $cm^2$, wherein a number of brush elements per tuft can be at least 500.

The acceleration needed for expelling dirt particles and liquid from the brush elements may be achieved at an angular velocity of the brush which is at least 6,000 revolutions per minute, wherein a diameter of the brush may be in a range of 20 to 80 mm when the brush elements are in a fully outstretched condition.

As has been mentioned in the foregoing, it is possible to set an indentation of the brush with respect to the surface to be cleaned. Such indentation of the brush is measured when taking into account a displacement of the brush with respect to a situation in which the tips of the brush elements in a fully outstretched condition touch the surface. On the basis of an indentation, it is ensured that the brush elements contact the surface to be cleaned for a certain time during each revolution of the brush, and that the brush elements will suddenly move from a bent condition to an outstretched condition as soon as there is room for doing so, so that picked-up dirt particles and liquid may be flung away.

The brush elements may be made of a plastic material, wherein polyester is a suitable example. In any case, the linear mass density of the brush elements is lower than 150 g per 10 km, at least at tip portions of the brush elements, wherein it is ensured that at least tip portions of the brush elements are flexible enough to undergo a bending effect and to pick up liquid and dirt, and that the extent of wear and tear of the brush elements is acceptable. When the material is a plastic, the linear mass density as mentioned, i.e. the linear mass density in grams per 10 kilometers, is also denoted as Dtex value.

A preferred upper limit of the linear mass density is 20 g per 10 km, and a most preferred upper limit of the linear mass density is 5 g per km. An important advantage of the lowest values of the linear mass density is that wear and tear of the brush elements are minimal. In any case, with the linear mass density as defined, the brush elements can be classified as being very soft and flexible, contrary to many situations known from the art, such as the situation described in EP 0 169 850, in which an apparatus is supported on a surface to be cleaned through the brushes which are arranged in the apparatus.

It is mentioned in the foregoing that the device of which the brush is part may be equipped with means for supplying a liquid to the brush. The brush does not need much liquid, and a supply of liquid may take place at a rate which is lower than 6 ml per minute per cm of a width of the brush, i.e. a dimension of the brush in a direction in which a rotation axis of the brush is extending, or, in case of two or more brushes, of a width of an assembly of brushes. It appears that is not necessary for the supply of liquid to take place at a higher rate, and that the rate suffices for the liquid to fulfill a function as carrying/transporting means for dirt particles, and to play a role in loosening stains. An advantage of only using a little liquid is that it is possible to treat delicate surfaces, even surfaces which are indicated as being sensitive to a liquid such as water. Furthermore, at a given size of a reservoir for containing the liquid to be supplied to the brush, an autonomy time is longer, i.e. it takes more time before the reservoir is empty and needs to be filled again.

It may be so that the dirt particles are blown away from the area where the brush is used to pick up these particles, especially when two counter-rotating brushes are used. In order to avoid such a disadvantageous effect, means for generating an airflow in an area where the brush contacts the surface to be cleaned may be applied, such that the airflow caused by the brushes during their operation is compensated for.

Alternatively, the device of which the at least one rotatable brush is part may be equipped with means for indenting the brush at a position directly before the brush contacts the surface to be cleaned. When such indenting means are present, it may be achieved that the blowing effect is obtained at another position than a position at the surface to be cleaned, so that the dirt particles and the liquid stay in place when the brush is moved across the surface on which the dirt particles and the liquid are located.

The brush which is used according to the present invention may be a spiraled brush, i.e. a brush having tufts which are arranged on the brush in a spiral-like pattern. When a vacuum source or the like is used as the means for generating an airflow and thereby avoiding a situation in which dirt particles and spilled liquid are only displaced when the brush passes, the spiraled configuration of the tufts significantly reduces the suction power needed. In general, in this context, it is advantageous if the tufts are arranged in rows with intermediate spacing.

The above-described and other aspects of the present invention will be apparent from and elucidated with reference to the following detailed description of a cleaning device having two rotatable brushes for picking up dirt particles and liquid from a surface to be cleaned.

BRIEF DESCRIPTION OF THE DRAWINGS

The present invention will now be explained in greater detail with reference to the figures, in which equal or similar parts are indicated by the same reference signs, and in which.

DETAILED DESCRIPTION OF EMBODIMENTS

Figure 1:
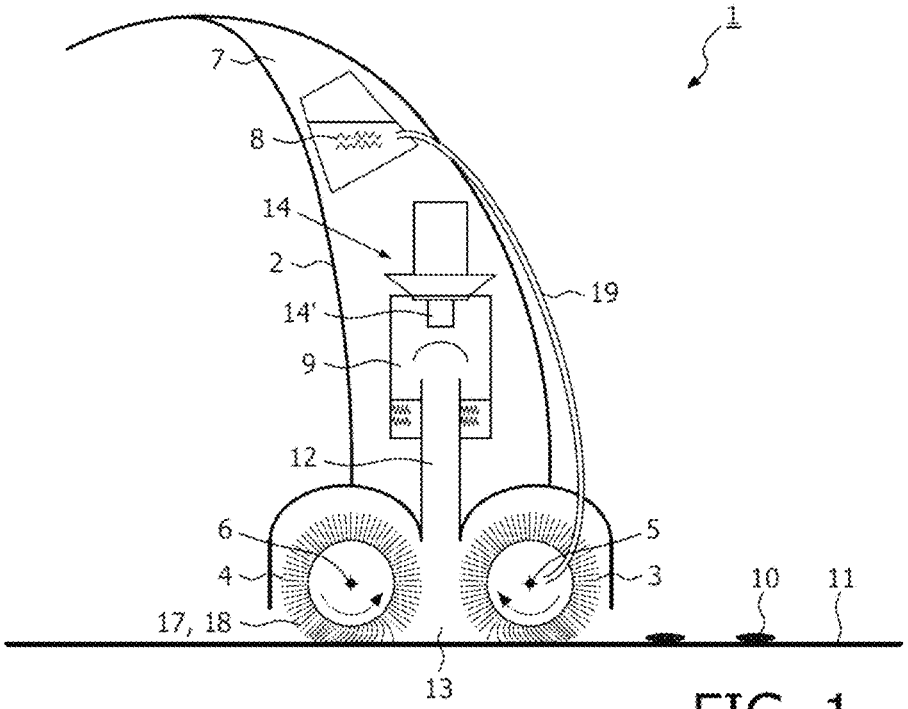
FIG. 1 is a schematic cross-section of a cleaning device according to the present invention.
Figure 2:
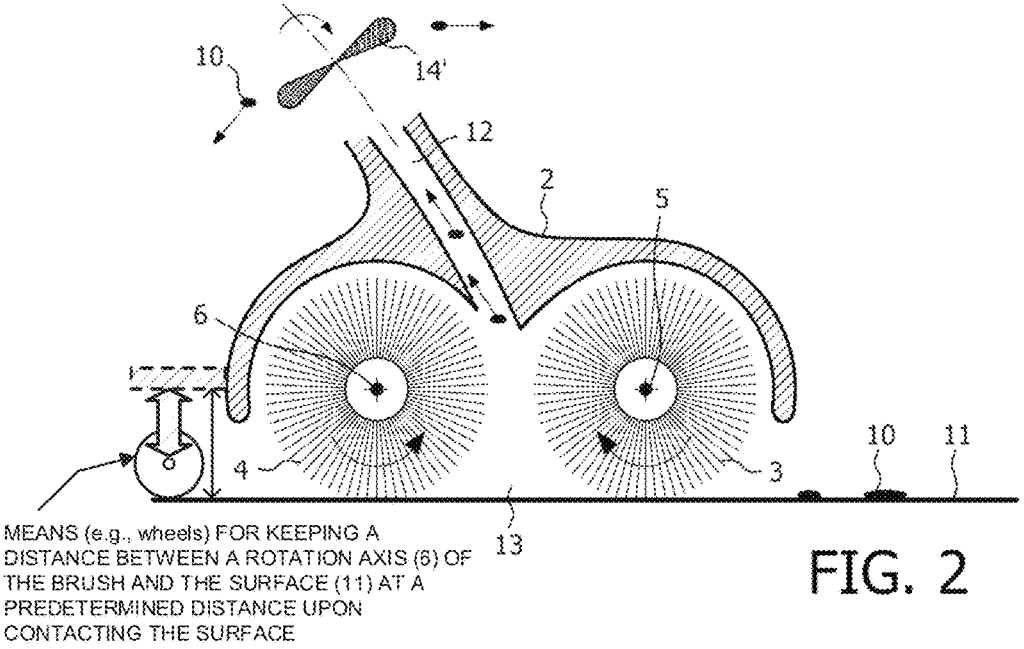
FIG. 2 shows a part of FIG. 1 in enlarged view.
Figure 3:
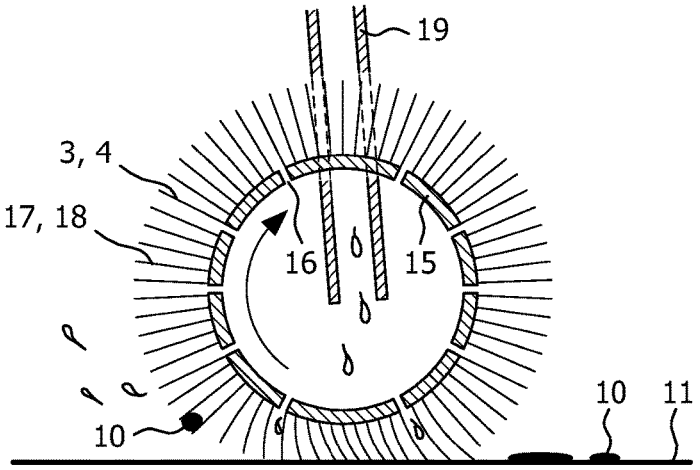
FIG. 3 is a schematic cross-section of a brush of the cleaning device as shown in FIG. 1.
Figure 4:
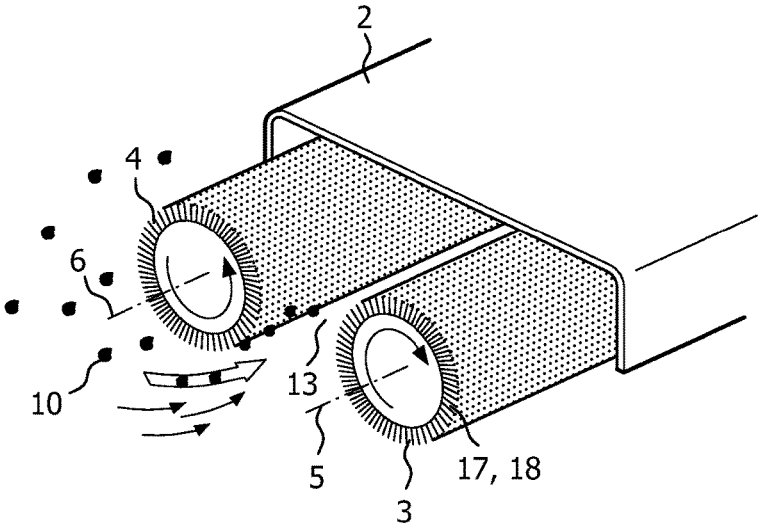
FIG. 4 schematically shows a perspective view of two brushes of the cleaning device as shown in FIG. 1.

FIGS. 1-4 relate to a cleaning device 1 according to the present invention, wherein FIG. 1 provides a view of the cleaning device 1 in its entirety. The cleaning device 1 comprises a housing 2 in which two brushes 3, 4 are rotatably mounted, which brushes 3, 4 are intended for contacting a surface 11 to be cleaned. As indicated in FIGS. 1, 2 and 4 by means of arrows, the brushes 3, 4 are rotatable in opposite directions, i.e. one of the brushes 3, 4 is rotatable in a clockwise direction, and another of the brushes 3, 4 is rotatable in a counterclockwise direction. For the purpose of driving the brushes 3, 4, the cleaning device 1 may comprise any suitable means such as a motor (not shown) which is located at a suitable position in the device 1.

The brushes 3, 4 may have a diameter which is in a range of 20 to 80 mm, and the driving means may be capable of rotating the brushes 3, 4 at an angular velocity which is at least 6,000 revolutions per minute. A width of the brushes 3, 4, i.e. a dimension of the brushes 3, 4 in a direction in which rotation axes 5, 6 of the brushes 3, 4 are extending, may be in an order of 25 cm, for example.

In the housing 2, means (not shown) such as wheels are arranged for keeping the rotation axes 5, 6 of the brushes 3, 4 at a predetermined distance from the surface 11 to be cleaned, wherein the distance is chosen such that the brush 3, 4 is indented. Preferably, the range of the indentation is from 2% to 12% of a diameter of the brush 3, 4 relating to a fully outstretched condition of the brush elements. Hence, when the diameter is in an order of 50 mm, the range of the indentation can be from 1 to 6 mm. Besides the housing 2 and the brushes 3, 4, the cleaning device 1 is provided with the following components:

- a handle 7 which allows for easy manipulation of the cleaning device 1 by a user;
- a reservoir 8 for containing a cleansing liquid such as water;
- a debris collecting container 9 for receiving liquid and particles 10 picked up from the surface 11 to be cleaned;
- a flow channel in the form of, for example, a hollow tube 12, connecting the debris collecting container 9 to an opening 13 between the brushes 3, 4, which opening 13 constitutes an inlet of the cleaning device 1; and
- a vacuum fan aggregate 14 comprising a centrifugal fan 14', arranged at a side of the debris collecting chamber 9 which is opposite to a side where the tube 12 is arranged.

For sake of completeness, it is noted that within the scope of the present invention, other and/or additional constructional details are possible. For example, an element may be provided for deflecting the debris that is flung upwards, so that the debris first undergoes a deflection before it eventually reaches the debris collecting chamber 9. Also, the vacuum fan aggregate 14 may be arranged at another side of the debris collecting chamber 9 than the side which is opposite to the side where the tube 12 is arranged.

The brushes 3, 4 comprise a core element 15. In at least one of the brushes 3, 4, the core element 15 is in the form of a hollow tube provided with a number of channels 16 extending through a wall of the core element 15. On an exterior surface of the core element 15 of the brushes 3, 4, tufts 17 are provided. Each tuft 17 comprises hundreds of fiber elements 18, which are referred to as brush elements 18. For example, the brush elements 18 are made of polyester with a diameter in an order of about 10 micrometers, and with a Dtex value which is lower than 150 g per 10 km. A packing density of the brush elements 18 may be at least 30 tufts 17 per $cm^2$ on the exterior surface of the core element 15 of the brushes 3, 4.

The brush elements 18 may be rather chaotically arranged, i.e. not at fixed mutual distances. Furthermore, it is mentioned that an exterior surface of the brush elements 18 may be uneven, which enhances the capability of the brush elements 18 to catch liquid droplets and dirt particles 10. In particular, the brush elements 18 may be so-called microfibers, which do not have a smooth and more or less circular circumference, but which have a rugged and more or less star-shaped circumference with notches and grooves instead. The brush elements 18 do not need to be identical, as long as it is true that the linear mass density of a majority of a total number of the brush elements 18 of the brush 3, 4 meets the requirement of being lower than 150 g per 10 km, at least at tip portions.

For the purpose of transporting cleansing fluid from the reservoir 8 to the inside of the hollow core element 15 of one of the brushes 3, 4, a flexible tube 19 is provided. During operation of the cleaning device 1, cleansing fluid is supplied to the hollow core element 15 as mentioned, wherein the liquid leaves the hollow core element 15 via the channels 16, and wets the brush elements 18, and also drizzles or falls on the surface 11 to be cleaned. Thus, the surface 11 to be cleaned becomes wet with the cleansing liquid. According to the present invention, the rate at which the liquid is supplied to the hollow core element 15 can be quite low, wherein a maximum rate can be 6 ml per minute per cm of the width of the brush 3, for example. It is noted that it is possible to supply the liquid to both brushes 3, 4, but that it is preferred to use only one brush 3, 4 in the wetting process, since this is easier to realize. Furthermore, this leaves a drier surface 11 in case the one brush 3, 4 is a brush 4 which is arranged at a back position, assuming a normal way of operation in which the last stroke performed with the cleaning device 1 by a user is always a backward stroke.

By means of the rotating brushes 3, 4, in particular by means of the brush elements 18 of the rotating brushes 3, 4, dirt particles 10 and liquid are picked up from the surface 11, and are transported to a collecting position inside the cleaning device 1. In the following explanation of this fact, a single brush element 18 is considered, wherein it is assumed that the brush element 18 is initially free from contact with the surface 11. Due to the rotation of the brush 3, 4 of which the brush element 18 is part, a moment occurs at which a first contact with the surface 11 is realized. The extent of contact is increased until the brush element 18 is bent in such a way that a tip portion of the brush element 18 is in contact with the surface 11. The tip portion as mentioned slides across the surface 11 and encounters dirt particles 10 and liquid in the process, wherein an encounter may lead to a situation in which a quantity of liquid and/or a dirt particle 10 are moved away from the surface 11 and are taken along by the brush element 18 on the basis of adhesion forces. In the process, the brush element 18 may act more or less like a whip for catching and dragging particles 10, which is force-closed and capable of holding on to a particle on the basis of a functioning which is comparable to the functioning of a band brake. Furthermore, the liquid which is picked up may pull a bit of liquid with it, wherein a line of liquid is left in the air, which is moving away from the surface 11. Also, the brush element 18 has a gentle scrubbing effect on the surface 11, which contributes to counteracting adhesion of liquid and particles 10 to the surface 11.

As the brush 3, 4 rotates, the movement of the brush element 18 over the surface 11 continues until a moment occurs at which contact is eventually lost. When there is no longer a situation of contact, the brush element 18 is urged to assume an original, outstretched condition under the influence of centrifugal forces which are acting on the brush element 18 as a result of the rotation of the brush 3, 4. As the brush element 18 is bent at the time that there is an urge to assume the outstretched condition again, an additional, outstretching acceleration is present at the tip of the brush element 18, wherein the brush element 18 swishes from the bent condition to the outstretched condition, wherein the movement of the brush element 18 is comparable to a whip which is swished. The acceleration at the tip at the time the brush element 18 has almost assumed the outstretched condition again meets a requirement of being at least 3,000 $m/sec^2$.

Under the influence of the forces acting at the tip of the brush element 18 during the movement as described, the quantities of dirt particles 10 and liquid are expelled from the brush element 18, as these forces are considerably higher than the adhesion forces. Hence, the liquid and the dirt are forced to fly away in a direction which is away from the surface 11. By having means for collecting the liquid and the dirt, and having these means arranged at a proper position in the cleaning device 1, it is ensured that the liquid and the dirt cannot reach the surface 11 again. In the shown example, the liquid and the dirt are thrown towards the tube 12 which is adapted to guide the liquid and the dirt towards the debris collecting container 9.

Under the influence of the acceleration, the liquid may be expelled in small droplets. This is advantageous for further separation processes such as performed by the vacuum fan aggregate 14, in particular the centrifugal fan 14' of the vacuum aggregate, which serves as a rotatable air-dirt separator. It is noted that suction forces such as the forces exerted by the centrifugal fan 14' do not play a role in the above-described process of picking up liquid and dirt by means of a brush element 18, but are only applicable to further processes of receiving and collecting the liquid and dirt at a position which is somewhere inside the cleaning device 1, i.e. not on the surface 11 which is cleaned, besides a process of preventing that dirt particles 10 are blown away from the area where the brushes 3, 4 are used to pick up these particles 10.

Besides the functioning of each of the brush elements 18, as described in the foregoing with respect to a single brush element 18, another effect which contributes to the process of picking up dirt particles 10 and liquid may occur, namely a capillary effect between the brush elements 18. In this respect, the brush 3, 4 with the brush elements 18 is comparable to a brush which is dipped in a quantity of paint, wherein paint is absorbed by the brush 3, 4 on the basis of capillary forces.

It appears from the foregoing that the cleaning device 1 according to the present invention has the following properties:

- the soft tufts 17 with the flexible brush elements 18 will be stretched out by centrifugal forces during the contact-free part of a revolution of the brushes 3, 4;
- it is possible to have a perfect fit between the brushes 3, 4 and the surface 11 to be cleaned, since the soft tufts 17 will bend whenever they touch the surface 11, and straighten out whenever possible under the influence of centrifugal forces;
- the brushes 3, 4 constantly clean themselves, due to sufficiently high acceleration forces, which ensures a constant cleaning result;
- heat generation between the surface 11 and the brushes 3, 4 is minimal, because of a very low bending stiffness of the tufts 17;
- a very even pick-up of liquid from the surface 11 and a very even overall cleaning result can be realized, even if creases or dents are present in the surface 11, on the basis of the fact that the liquid is picked up by the tufts 17 and not by an airflow as in many conventional devices; and
- dirt is removed from the surface in a gentle yet effective way, by means of the tufts 17, wherein a most efficient use of energy can be realized on the basis of the low stiffness of the brush elements 18.

On the basis of the relatively low value of the linear mass density, it may be so that the brush elements 18 have very low bending stiffness, and, when packed in tufts 17, are not capable of remaining in their original shape. In conventional brushes, the brush elements spring back once released. However, the brush elements 18 having the very low bending stiffness as mentioned will not do that, since the elastic forces are so small that they cannot exceed internal friction forces which are present between the individual brush elements 18. Hence, the tufts 17 will remain crushed after deformation, and will only stretch out when the brushes 3, 4 are rotating.

In comparison with conventional devices comprising hard brushes for contacting a surface to be cleaned, and using suction power and/or a squeegee, the device 1 according to the present invention is capable of realizing cleaning results which are significantly better, due to the working principle according to which brush elements 18 are used for picking up liquid and dirt and taking the liquid and the dirt away from the surface 11 to be cleaned, wherein the liquid and the dirt are flung away by the brush elements 18 before they contact the surface 11 again in a next round.

It is noted that the maximum value of 150 g per 10 km in respect of the linear mass density of a majority of a total number of the brush elements 18 of the brush 3, 4, at least at tip portions of the brush elements 18 which are used for picking up dirt particles and liquid, is supported by results of experiments which have been performed in the context of the present invention.

In the following, one of the experiments and the results of the experiment will be described. Brushes 3, 4 having different types of fibers were tested, including relatively thick fibers and relatively thin fibers. The particulars of the various brushes are given in the following table.

| | packing density (# tufts/ $cm^2$) | fibers per tuft | Dtex value (g/10 km) | fiber material | fiber length (mm) | fiber appearance |
|---|---|---|---|---|---|---|
| brush 1 | 160 | 9 | 113.5 | nylon | 10 | springy, straight |
| brush 2 | 25 | 35 | 31.0 | nylon | 11 | fairly hard, curled |
| brush 3 | 40 | 90 | 16.1 | — | 11 | very soft, twined |
| brush 4 | 50 | 798 | 0.8 | polyester | 11 | very soft, twined |

The experiment includes rotating the brushes 3, 4 under similar conditions and assessing cleaning results, wear, and power to the surface 11 subjected to treatment with the brushes 3, 4, which provides an indication of heat generation on the surface 11. The outcome of the experiment is reflected in the following table, wherein a mark 5 is used for indicating the best results, and lower marks are used for indicating poorer results.

| | stain removal | water pick-up | wear | power to the surface |
|---|---|---|---|---|
| Brush 1 | 5 | 3 | 3 | 3 |
| Brush 2 | 5 | 3 | 1 | 4 |
| Brush 3 | 5 | 4 | 4 | 5 |
| Brush 4 | 5 | 5 | 5 | 5 |

Among other things, the experiment proves that it is possible to have brush elements 18 with a linear mass density in a range of 100 to 150 g per 10 km, and obtain useful cleaning results, although it appears that the water pick-up, the wear behavior and the power consumption are not so good, wherein there is a risk of damaging the surface 11. It is concluded that an appropriate limit value for the linear mass density is 150 g per 10 km. However, it is clear that with a much lower linear mass density, the cleaning results and all other results are very good. Therefore, it is preferred to apply lower limit values, such as 125 g per 10 km, 50 g per 10 km, 20 g per 10 km, or even 5 g per 10 km. With values in the latter order, it is ensured that cleaning results are excellent, water pick-up is optimal, wear is minimal, and power consumption and heat generation on the surface 11 are sufficiently low.

It is noted that the minimum value of 3,000 m/$sec^2$ in respect of the acceleration which is prevailing at tips of the brush elements 18 during some time per revolution of the brushes 3, 4, in particular some time during another period than the period of picking up dirt and liquid from a surface 11, in which other period there is no contact between the brush elements 18 and the surface 11, is supported by results of experiments which have been performed in the context of the present invention.

In the following, one of the experiments and the results of the experiment will be described. The following conditions are applicable to the experiment:

1) A brush 3, 4 having a diameter of 46 mm, a width of approximately 12 cm, and polyester brush elements 18 with a linear mass density of about 0.8 g per 10 km, arranged in tufts 17 of about 800 brush elements 18, with approximately 50 tufts 17 per $cm^2$, is mounted on a motor shaft.

2) The weight of the assembly of the brush 3, 4 and the motor is determined.

3) The power supply of the motor is connected to a timer for stopping the motor after a period of operation of 1 second or a period of operation of 4 seconds.

4) The brush 3, 4 is immersed in water, so that the brush 3, 4 is completely saturated with the water. It is noted that the brush 3, 4 which is used appears to be capable of absorbing a total weight of water of approximately 70 g.

5) The brush 3, 4 is rotated at an angular velocity of 1,950 revolutions per minute, and is stopped after 1 second or 4 seconds.

6) The weight of the assembly of the brush 3, 4 and the motor is determined, and the difference with respect to the dry weight, which is determined under step 2), is calculated.

7) Steps 4) to 6) are repeated for other values of the angular velocity, in particular the values as indicated in the following table, which further contains values of the weight of the water still present in the brush 3, 4 at the stops after 1 second and 4 seconds, and values of the associated centrifugal acceleration, which can be calculated according to the following equation:

$$a=(2*\pi*f)^2*R$$

in which:

a=centrifugal acceleration (m/$s^2$)

f=brush frequency (Hz)

R=radius of the brush 3, 4 (m)

| angular velocity (rpm) | weight of water present after 1 s (g) | weight of water present after 4 s (g) | centrifugal acceleration (m/$s^2$) |
|---|---|---|---|
| 1,950 | 8.27 | 7.50 | 959 |
| 2,480 | 5.70 | 4.57 | 1,551 |
| 3,080 | 3.70 | 3.11 | 2,393 |
| 4,280 | 2.52 | 1.97 | 4,620 |
| 5,540 | 1.95 | 1.35 | 7,741 |
| 6,830 | 1.72 | 1.14 | 11,765 |
| 7,910 | 1.48 | 1.00 | 15,780 |
| 9,140 | 1.34 | 0.94 | 21,069 |

Figure 5:
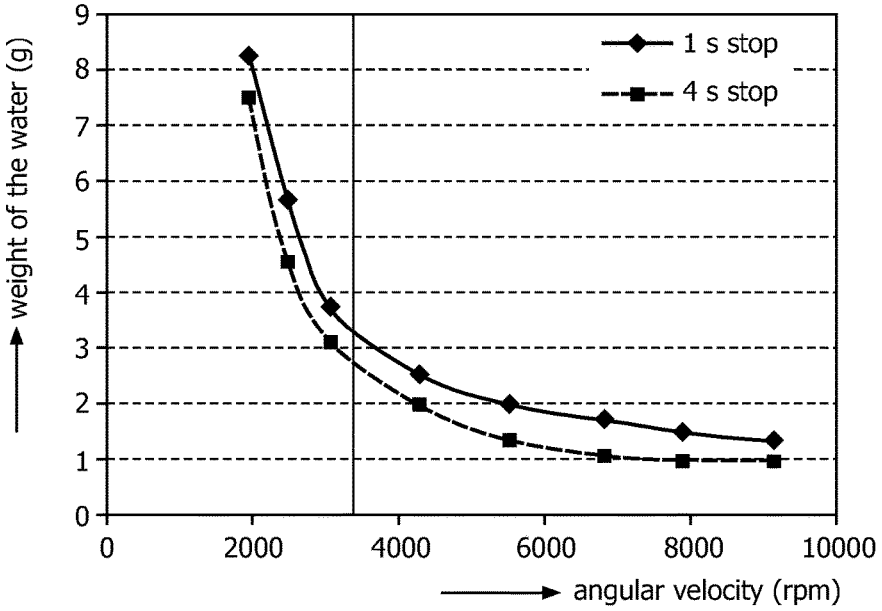
FIG. 5 shows a graph which serves for illustrating a relation between an angular velocity of a brush and a self-cleaning capacity of the brush.
Figure 6:
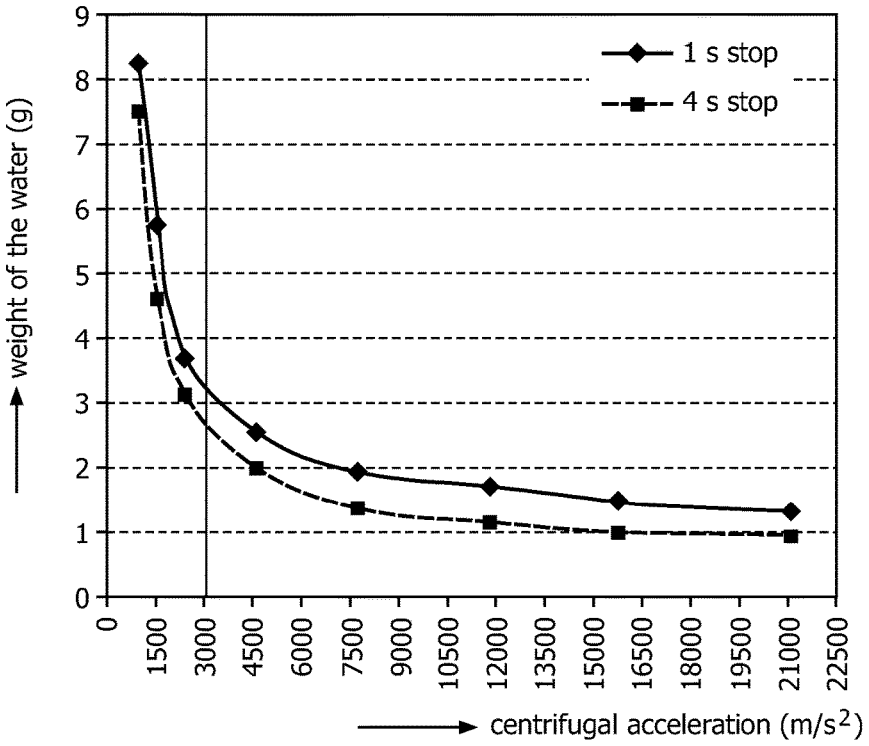
FIG. 6 shows a graph which serves for illustrating a relation between a centrifugal acceleration of a brush and a self-cleaning capacity of the brush.

The relation which is found between the angular velocity and the weight of the water for the two different stops is depicted in the graph of FIG. 5, and the relation which is found between the centrifugal acceleration and the weight of the water for the two different stops is depicted in the graph of FIG. 6, wherein the weight of the water is indicated at the vertical axis of each of the graphs. It appears from the graph of FIG. 5 that the release of water by the brush 3, 4 strongly decreases when the angular velocity is lower than about 4,000 rpm. Also, it seems to be rather stable at angular velocities which are higher than 6,000 rpm to 7,000 rpm.

A transition in the release of water by the brush can be found at an angular velocity of 3,500 rpm, which corresponds to a centrifugal acceleration of 3,090 m/$s^2$. For sake of illustration of this fact, the graphs of FIGS. 5 and 6 contain a vertical line indicating the values of 3,500 rpm and 3,090 m/$s^2$, respectively.

On the basis of the results of the experiment as explained in the foregoing, it may be concluded that a value of 3,000 $m/s^2$ in respect of an acceleration at tips of the brush elements 18 during a contact-free period is a realistic minimum value as far as the self-cleaning capacity of brush elements 18 which meet the requirement of having a linear mass density which is lower than 150 g per 10 km, at least at tip portions, is concerned. A proper performance of the self-cleaning function is important for obtaining good cleaning results, as has already been explained in the foregoing.

For sake of completeness, it is noted that in the cleaning device 1 according to the present invention, the centrifugal acceleration may be lower than 3,000 $m/s^2$. The reason is that the acceleration which occurs at tips of the brush elements 18 when the brush elements 18 are straightened out can be expected to be higher than the normal centrifugal acceleration. The experiment shows that a minimum value of 3,000 $m/s^2$ is valid in respect of an acceleration, which is the normal, centrifugal acceleration in the case of the experiment, and which can be the higher acceleration which is caused by the specific behavior of the brush elements 18 when the dirt pick-up period has passed and there is room for straightening out in an actual cleaning device 1 according to the present invention, which leaves a possibility for the normal, centrifugal acceleration in that device 1 to be lower.

As a result of the fact that the brushes 3, 4 are indented by the surface 11 to be cleaned, the brushes 3, 4 act like a kind of gear pump which pumps air from the inside of the cleaning device 1 to the outside. This is an effect which is disadvantageous, as dirt particles are blown away and droplets of liquid are formed at positions where they are out of reach from the brushes 3, 4, and can fall down at unexpected moments during a cleaning process. In order to compensate for the pumping effect as mentioned, it is proposed to have means for generating an airflow in an area where the brushes 3, 4 contact the surface 11, which airflow is used to compensate for the airflow generated by the brushes 3, 4. In this respect, it is preferred for the brushes 3, 4 to have tufts 17 which are arranged in rows on the brushes 3, 4, so that the necessary suction power will be significantly reduced. It is also possible to use means for indenting the brushes 3, 4 at a position directly before the brushes 3, 4 contact the surface 11, so that the airflow is no longer created near the surface 11 but inside the cleaning device 1, where it can be treated in a desired way. Examples of means as mentioned are found in PCT/IB2009/054333 and PCT/IB2009/054334, both in the name of Applicant.

The airflow which needs to be compensated for per brush 3, 4 can be calculated, using the following equation:

$$\Phi_c=\pi*f*W*F*(D*I-I^2)$$

in which:

$\Phi_c$=airflow which needs to be compensated for ($m^3/s$)
f=brush frequency (Hz)
W=width of the brush 3, 4 (m)
F=brush compensation factor (–)
D=diameter of the brush 3, 4 (m)
I=indentation of the brush 3, 4 by the surface 11 (m)

In a practical example, f=133 Hz, W=0.25 m, D=0.044 m, and I=0.003 m. In respect of the brush compensation factor, it is noted that this factor is determined on the basis of experiments with brushes 3, 4 having features of the practical example as mentioned, and is found to be 0.4. With the values as mentioned, the following compensation flow is found:

$$\Phi_c=\pi*133*0.25*0.4*(0.044*0.003-0.003^2)=0.005015\ m^3/s$$

Hence, in this example, it is advantageous to have a compensating airflow per brush 3, 4 of about 5 liters per second. Such an airflow can very well be realized in practice, so that the disadvantageous pumping effect of the two counter-rotating brushes 3, 4 can actually be dispensed with.

It will be clear to a person skilled in the art that the scope of the present invention is not limited to the examples discussed in the foregoing, but that several amendments and modifications thereof are possible without deviating from the scope of the present invention as defined in the attached claims. While the present invention has been illustrated and described in detail in the figures and the description, such illustration and description are to be considered illustrative or exemplary only, and not restrictive. The present invention is not limited to the disclosed embodiments.

Variations to the disclosed embodiments can be understood and effected by a person skilled in the art in practicing the claimed invention, from a study of the figures, the description and the attached claims. In the claims, the word "comprising" does not exclude other steps or elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope of the present invention.

For sake of clarity, it is noted that a fully outstretched condition of the brush elements 18 is a condition in which the brush elements 18 are fully extending in a radial direction with respect to a rotation axis of the brush 3, 4, wherein there is no bent tip portion in the brush elements 18. This condition can be realized when the brush 3, 4 is rotating at a normal operative speed, which is a speed at which the acceleration of 3,000 $m/sec^2$ at the tips of the brush elements 18 can be realized. It is possible for only a portion of the brush elements 18 of a brush 3, 4 to be in the fully outstretched condition, while another portion is not, due to obstructions which are encountered by the brush elements 18. Normally, the diameter D of the brush 3, 4 is determined with all of the brush elements 18 in the fully outstretched condition.

The tip portions of the brush elements 18 are outer portions of the brush elements 18 as seen in the radial direction, i.e. portions which are the most remote from the rotation axis. In particular, the tip portions are the portions which are used for picking up dirt particles 10 and liquid, and which are made to slide along the surface 11 to be cleaned. In case the brush 3, 4 is indented with respect to the surface 11, a length of the tip portion is approximately the same as the indentation I.

The present invention can be summarized as follows. A device 1 for cleaning a surface 11 comprises at least one rotatable brush 3, 4 which is provided with flexible brush elements 18 for contacting the surface 11 to be cleaned and picking up dirt particles and liquid which are present on the surface during a dirt pick-up period of each revolution of the brush, and means for driving the brush 3, 4. Excellent cleaning results are obtained by most effectively removing dirt particles 10 and liquid from the surface 11 to be cleaned, which is actually realized by having the following combination of operating parameters: a linear mass density of the flexible brush elements 18 which is lower than 0.01 to 150 g per 10 km, at least at tip portions which are used for picking up dirt particles and liquid, and an acceleration at tips of the brush elements 18 which is at least 3,000 $m/sec^2$, at least at some time during another period of each revolution of the brush 3, 4 than the dirt pick-up period, namely a period in which the brush elements 18 are free from contact to the surface 11 to be cleaned, and first move away from the surface 11 and subsequently move towards the surface 11 again.

On the basis of the foregoing description of the present invention, it is noted that the invention also relates to a method of design for a device 1 for cleaning a surface 11, comprising at least one rotatable brush 3, 4 which is provided with flexible brush elements 18 for contacting the surface 11 to be cleaned and picking up dirt particles and liquid which are present on the surface during a dirt pick-up period of each revolution of the brush, and means for driving the brush 3, 4, wherein the cleaning device 1 is optimized by choosing a linear mass density of the brush elements 18 to be lower than 150 g per 10 km, at least at tip portions of the brush elements 18 which are used for picking up dirt particles 10 and liquid, for a majority of a total number of the brush elements 18, and by choosing characteristics of the means for driving the brush 3, 4 which enable the means to realize an acceleration at tips of the brush elements 18 which is at least 3,000 m/sec$^2$, at least at some time during another period of each revolution of the brush 3, 4 than the dirt pick-up period, namely a period in which the brush elements 18 are free from contact to the surface 11, and first move away from the surface 11 and subsequently move towards the surface 11 again.

Preferred ways of carrying out the method of design for the cleaning device 1 are aimed at additionally realizing at least one of the ranges and/or limits of other operating parameters and constructional measures which are described in the foregoing as possibilities existing within the scope of the present invention.

Furthermore, it is noted that the invention also relates to a method for cleaning a surface 11, wherein at least one brush 3, 4 which is provided with flexible brush elements 18 is applied, a majority of a total number of the brush elements 18 having a linear mass density which is lower than 150 g per 10 km, at least at tip portions, wherein the brush 3, 4 is rotated, and wherein the brush elements 18 of the brush 3, 4 are made to contact the surface 11 to be cleaned and to pick up dirt particles 10 and liquid which are present on the surface 11 during a pick-up period of each revolution of the brush 3, 4, wherein tips of the brush elements 18 are made to accelerate with an acceleration which is at least 3,000 m/sec$^2$, at least at some time during another period of each revolution of the brush 3, 4 than the dirt pick-up period, namely a period in which the brush elements 18 are free from contact to the surface 11, and first move away from the surface 11 and subsequently move towards the surface 11 again.

Preferred options existing in respect of the method as defined in the foregoing include the following:

- the brush 3, 4 is indented with an indentation I which is in a range from 2% to 12% of a diameter of the brush 3, 4 relating to an outstretched condition of the brush elements 18;
- the brush 3, 4 is driven at an angular velocity which is at least 6,000 revolutions per minute;
- an airflow is generated in an area where the brush 3, 4 contacts the surface 11 to be cleaned;
- the brush 3, 4 is indented directly before the brush 3, 4 contacts the surface 11 to be cleaned; and
- a liquid is supplied to the brush 3, 4, at a rate which is lower than 6 ml per minute per cm of a width W of the brush 3, 4, i.e. a dimension of the brush 3, 4 in a direction in which a rotation axis 5, 6 of the brush 3, 4 is extending.

Other preferred ways of carrying out the method for cleaning a surface 11 are aimed at additionally realizing at least one of the ranges and/or limits of other operating parameters and constructional measures which are also described in the foregoing as possibilities existing within the scope of the present invention.

The invention claimed is:

1. A cleaning device for movement across a surface to sweep dirt particles and liquid from said surface, said cleaning device comprising:

a. a brush arranged in the device for rotation about an axis and including a multiplicity of radially extending flexible brush elements that comprise microfiber brush elements packed in tufts, wherein the brush has a maximum diameter relating to a fully outstretched condition of the brush elements, the brush elements further having respective tip portions for contacting the surface, wherein a majority of a total number of said tip portions of the brush elements have a linear mass density of 0.8 g per 10 km, wherein the brush elements further have a bending stiffness based on the linear mass density being 0.8 g per 10 km (i) that renders the brush elements incapable of remaining in an original outstretched shape when the brush is not rotating and (ii) that only stretch out to the fully outstretched condition when the brush is rotating; and b. a drive apparatus coupled to the brush for rotating said brush about said axis such that the tip portions repeatedly make momentary contact with the surface and are thereby deformed to wipe across said surface and pick up said dirt particles and liquid, said drive apparatus being powered during operation to suddenly accelerate said tip portions from a first lower rate, when deformed, to a second higher rate of at least 3,000 m/sec$^2$ as said tip portions break free from contact with the surface and tend to straighten out, said accelerated tip portions flinging the dirt particles and liquid into a channel of the cleaning device for collection.

2. A cleaning device according to claim 1, further comprising means for keeping a distance between (i) a rotation axis of the brush and (ii) the surface at a predetermined distance upon contacting the surface, wherein the predetermined distance establishes an indentation (I) of the brush elements that is in a range from 2% to 12% of a diameter of the brush elements when in the fully outstretched condition.

3. A cleaning device according to claim 1 where a packing density of the brush elements is at least 30 tufts of brush elements per cm$^2$, and where a number of brush elements per tuft is at least 500.

4. A cleaning device according to claim 1 where the drive apparatus coupled to the brush is powered during operation to suddenly accelerate said tip portions from a first lower rate, when deformed, to a second higher rate of at least 7,000 m/sec$^2$ as said tip portions break free from contact with the surface and tend to straighten out.

5. A cleaning device according to claim 1 where the drive apparatus coupled to the brush is powered during operation to suddenly accelerate said tip portions from a first lower rate, when deformed, to a second higher rate of at least 12,000 m/sec$^2$ as said tip portions break free from contact with the surface and tend to straighten out.

6. A cleaning device according to claim 1 where the drive apparatus coupled to the brush is powered during operation to suddenly accelerate said tip portions from a first lower rate when deformed to a second higher rate of at least 6,000 revolutions per minute.

7. A cleaning device according to claim 1 where the brush has a diameter (D) which is in a range of 20 to 80 mm when the brush elements are in a fully outstretched condition.

8. A cleaning device according to claim 1 including a source for supplying a liquid to the brush at a rate which is lower than 6 ml per minute per cm of a width (W) of the brush.

9. A cleaning device according to claim 1 where, in operation, an airflow is produced in an area where the brush contacts the surface to be cleaned to compensate for an airflow produced by the brush elements during operation of the device.

10. A cleaning device according to claim 1 where, in operation, the brush elements are indented directly before the brush contacts the surface to be cleaned.

11. A cleaning device according to claim 1 where the brush comprises tufts arranged in a spiral-like pattern.

12. A cleaning device according to claim 1 comprising respective first and second ones of said brushes, each arranged for rotation about a respective axis in a direction opposite from that of the other.

13. A cleaning device according to claim 12 including a source for supplying a liquid to only one of the first and second brushes.

* * * * *